US007089750B2

(12) United States Patent
Pruitt et al.

(10) Patent No.: US 7,089,750 B2
(45) Date of Patent: Aug. 15, 2006

(54) EXPANSION-NOZZLE CRYOGENIC REFRIGERATION SYSTEM WITH RECIPROCATING COMPRESSOR

(75) Inventors: Gerald R. Pruitt, San Pedro, CA (US); Kenneth D. Price, Long Beach, CA (US); Carl S. Kirkconnell, Huntington Beach, CA (US)

(73) Assignee: Raytheon Company, Waltham, MA (US)

( * ) Notice: Subject to any disclaimer, the term of this patent is extended or adjusted under 35 U.S.C. 154(b) by 395 days.

(21) Appl. No.: 10/733,504

(22) Filed: Dec. 11, 2003

(65) Prior Publication Data

US 2004/0123605 A1 Jul. 1, 2004

(51) Int. Cl.
*F25D 9/00* (2006.01)
*F25B 19/02* (2006.01)

(52) U.S. Cl. ..... 62/6; 62/51.2

(58) Field of Classification Search ..... 62/6, 62/51.2, 615; 257/E23.137
See application file for complete search history.

(56) References Cited

U.S. PATENT DOCUMENTS 5,099,650 A * 3/1992 Crunkleton ..... 62/6
5,241,869 A * 9/1993 Czernichow ..... 73/864.52
5,412,951 A 5/1995 Wu
5,655,376 A * 8/1997 Price ..... 62/6
5,944,302 A 8/1999 Loc

* cited by examiner

*Primary Examiner*—Melvin Jones
(74) *Attorney, Agent, or Firm*—Leonard A. Alkov, Esq.; John E. Gunther; Karl A. Vick

(57) ABSTRACT

A cryogenic refrigeration system includes an expansion nozzle having a high-pressure nozzle inlet and a low-pressure nozzle outlet, and a compressor having a compression device, such as a pair of opposing pistons, operable to compress gas within a compression volume. The compression volume has an inlet port and an outlet port. A flapper inlet valve has an inlet valve inlet, and an inlet valve outlet in gaseous communication with the inlet port of the compression volume. The inlet valve opens when a gaseous pressure at the inlet valve inlet is sufficiently greater than a gaseous pressure in the compression volume to overcome a spring force of the flapper inlet valve. A flapper outlet valve has an outlet valve inlet in gaseous communication with the outlet port of the compression volume, and an outlet valve outlet in gaseous communication with the nozzle inlet. The outlet valve opens when a gaseous pressure in the compression volume is greater than a gaseous pressure at the outlet valve outlet to overcome a spring force of the flapper outlet valve. A drive motor system is in driving mechanical communication with the compression pistons. The compression volume is hermetically isolated from the drive motor system.

18 Claims, 3 Drawing Sheets

EXPANSION-NOZZLE CRYOGENIC REFRIGERATION SYSTEM WITH RECIPROCATING COMPRESSOR

This invention relates to a refrigeration system for reaching cryogenic temperatures near absolute zero and, more particularly, to an expansion-type cryogenic refrigerator with a high-performance compressor.

BACKGROUND OF THE INVENTION

A number of applications require the cooling of electronic devices to low cryogenic temperatures for their proper and efficient operation. For example, highly sensitive infrared sensors carried on spacecraft and used for remote sensing must be cooled to a temperature below about 15 K.

A cryogenic refrigeration system is used to achieve such low temperatures. A number of different types of cryogenic refrigeration systems are available, based upon different thermodynamic cycles. For the space applications of most interest, a cryogenic refrigeration system based upon the Joule-Thomson principle is preferred. Briefly, in a preferred Joule-Thomson cryogenic refrigeration system for achieving very low temperatures, helium or other suitable working gas is compressed, precooled, and expanded through an expansion nozzle. The expansion of the gas cools the gas and may liquefy it. The expanded or liquefied gas absorbs heat from the surroundings, such as the infrared sensor. The expanded or liquefied gas is then contacted to the incoming compressed gas in a heat exchanger to precool the incoming compressed gas, and thereafter expelled or, more typically, recycled back through the compressor, heat exchanger, and expansion nozzle. A properly designed Joule-Thomson refrigeration system cycle can reach temperatures of less than 15 K.

Because the working gas expands through the small expansion nozzle and cools, the gas must be free of condensable contaminants. Condensable contaminants, such as gases other than helium, may condense in the orifice of the expansion nozzle to partially or completely plug it, and thereby render the expansion nozzle and the cryogenic refrigeration system partially or completely inoperable.

The compressor is normally the only part of the cryogenic refrigeration system that has moving parts, and it therefore must be carefully selected to avoid contamination of the working gas. Some types of compressors, such as those used for Joule-Thomson cryogenic refrigeration systems operating at higher temperatures, are simply not candidates for low-temperature Joule-Thomson refrigeration systems, because too much contamination reaches the working gas, such as lubricants in the drive and in-leaked gas. The compressor desirably can achieve the required compression ratio in a single compression stage, because a reduction in mechanical complexity is highly desired in a compressor that is largely inaccessible while in space. This desired feature rules out some compressors.

Various other types of compressors could potentially meet these requirements and are therefore candidates for use in Joule-Thomson cryogenic refrigeration systems. Rotary vane compressors can achieve the required pressure ratios in only two stages, but suffer from a contamination of the working gas and wear problems that limit their lives. Sorption compressors may require multiple stages, and they are inefficient and sensitive to poisoning of the sorbent materials. Other multi-step valved compressors can meet the pressure ratio requirements but are also susceptible to contamination of the working gas which may clog the Joule-Thomson expansion orifice. Compressors used in Stirling cycle cryogenic refrigeration systems potentially could be used, but they produce a pressure wave and do not supply the steady pressure needed on the high-pressure nozzle inlet of the expansion nozzle.

There is a need, as yet not met, for a cryogenic refrigeration system operable at low cryogenic temperatures, such as 15 K or less, wherein the compressor meets the requirements discussed above. It is further desirable to satisfy this need with a single stage of compression. The present invention fulfills this need, and further provides related advantages.

SUMMARY OF THE INVENTION

The present approach provides a cryogenic refrigeration system that is functional at low temperatures such as below 15 K, and particularly at temperatures near to absolute zero. The cryogenic refrigeration system is suitable for use in space applications, such as the cooling of sensors. The cryogenic refrigeration system includes a gas expansion nozzle. The gas supplied to the gas expansion nozzle is free of contaminants that might otherwise condense and plug the gas expansion nozzle. A single-stage compressor supplies the required high gas pressure.

In accordance with the invention, a cryogenic refrigeration system comprises an expansion nozzle having a high-pressure nozzle inlet and a low-pressure nozzle outlet, an expansion volume in gaseous communication with the nozzle outlet, and a compressor. Desirably, a pressure ratio of the inlet pressure at the high-pressure nozzle inlet to the outlet pressure at the low-pressure nozzle outlet exceeds 15:1, allowing a single stage compressor to provide the desired operational pressure. The compressor comprises a reciprocating compression device, such as a single compression piston or a pair of opposing compression pistons, operable to compress gas within a compression volume, wherein the compression volume has an inlet port and an outlet port. A flapper inlet valve has an inlet valve inlet, and an inlet valve outlet in gaseous communication with the inlet port of the compression volume. The inlet valve opens when a gaseous pressure at the inlet valve inlet exceeds a gaseous pressure in the compression volume sufficiently to offset a spring-loaded seating pressure on this inlet valve. A flapper outlet valve has an outlet valve inlet in gaseous communication with the outlet port of the compression volume, and an outlet valve outlet in gaseous communication with the nozzle inlet. The outlet valve opens when a gaseous pressure in the compression volume exceeds a gaseous pressure at the outlet valve outlet sufficiently to offset a spring-loaded seating pressure on this outlet valve. In a preferred embodiment, the void volumes of the inlet valve and the outlet valve that communicate directly with the swept portion of the compression volume are sufficiently small so that a pressure ratio of at least 15:1 is achievable with a single stage of compression. A drive motor is in driving mechanical communication with the reciprocating compression device and is hermetically isolated from the compression volume so that gaseous contaminants resulting from the fabrication of the drive motor cannot contaminate the working gas in the compression volume.

The cryogenic refrigeration system operates with a working gas that is compressed and expanded through the expansion nozzle. The working gas may be of any operable type, and is typically selected according to the required cryogenic temperature that must be attained. For the lowest cryogenic temperatures, below 15 K, the working gas is helium, as this is the only gas that cools during expansion at this temperature.

The working gas may be compressed, expanded, and then vented. More typically, a closed-cycle gas system is used, both to conserve the working gas and also to improve the cooling efficiency by using the expanded working gas to precool the compressed working gas before it is expanded. In such a closed-cycle gas system, the inlet valve inlet is in gaseous communication with the nozzle outlet. There is usually a heat exchanger, and the gas flow is arranged so that the outlet valve outlet is in gaseous communication with the nozzle inlet through a first channel of the heat exchanger, and the nozzle outlet is in gaseous communication with the inlet valve inlet through a second channel of the heat exchanger. A countercurrent heat exchanger is preferred.

Particular attention is given to the structure of the compressor, as it is the only element of the cryogenic refrigeration system with moving parts. In the preferred compressor, each of the (one or two) compression pistons is suspended by flexures that allow them to move without the use of bearings that would require lubrication. The compressor and the drive motor are desirably contained within a single hermetically sealed compressor housing, to prevent loss of gas from the compressor and drive motor, and to prevent in-diffusion of contaminants into the working gas. The drive motor comprises a linear drive motor having a respective motor coil, and a respective magnet structure. In one approach, there is a movable motor coil affixed to each of the compression pistons, and a stationary associated magnet structure for each of the compression pistons. Alternative approaches, wherein the motor coil is fixed and the magnet structure is movable, or wherein the motor coil and the magnet structure are fixed and a back iron structure is movable, may be used. A piston position sensor, preferably a linear variable differential transformer (LVDT), may be used to provide positional input to a vibration control circuit that powers the actuating motor coils.

Each of the flapper valves is arranged to open when the pressure on its inlet is sufficiently greater than the pressure on its outlet to overcome the spring forces of the valve and an optional compression spring. Either or both of the flapper valves may be preloaded by a compression spring that preloads the flapper seal. Either or both of the flapper valves may be non-preloaded, with no separate compression spring that preloads the flapper seal (although the flapper valve itself has some spring force that must be overcome to open the valve).

There is typically a cooled article in thermal communication with the expansion volume. In the cases of most interest, the cooled article is a sensor such as an infrared sensor, which must be cooled to cryogenic temperatures to be fully functional, or an electronics component, which achieves its lowest noise characteristics when cooled to cryogenic temperatures.

The present approach provides a cryogenic refrigeration system wherein the compressor delivers a high-pressure, contaminant-free working gas to an expansion nozzle. The compressor has a simple mechanical design that is operable for extended periods of time, and achieves a 15:1 (or more) compression ratio so that only a single stage of compression is required. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
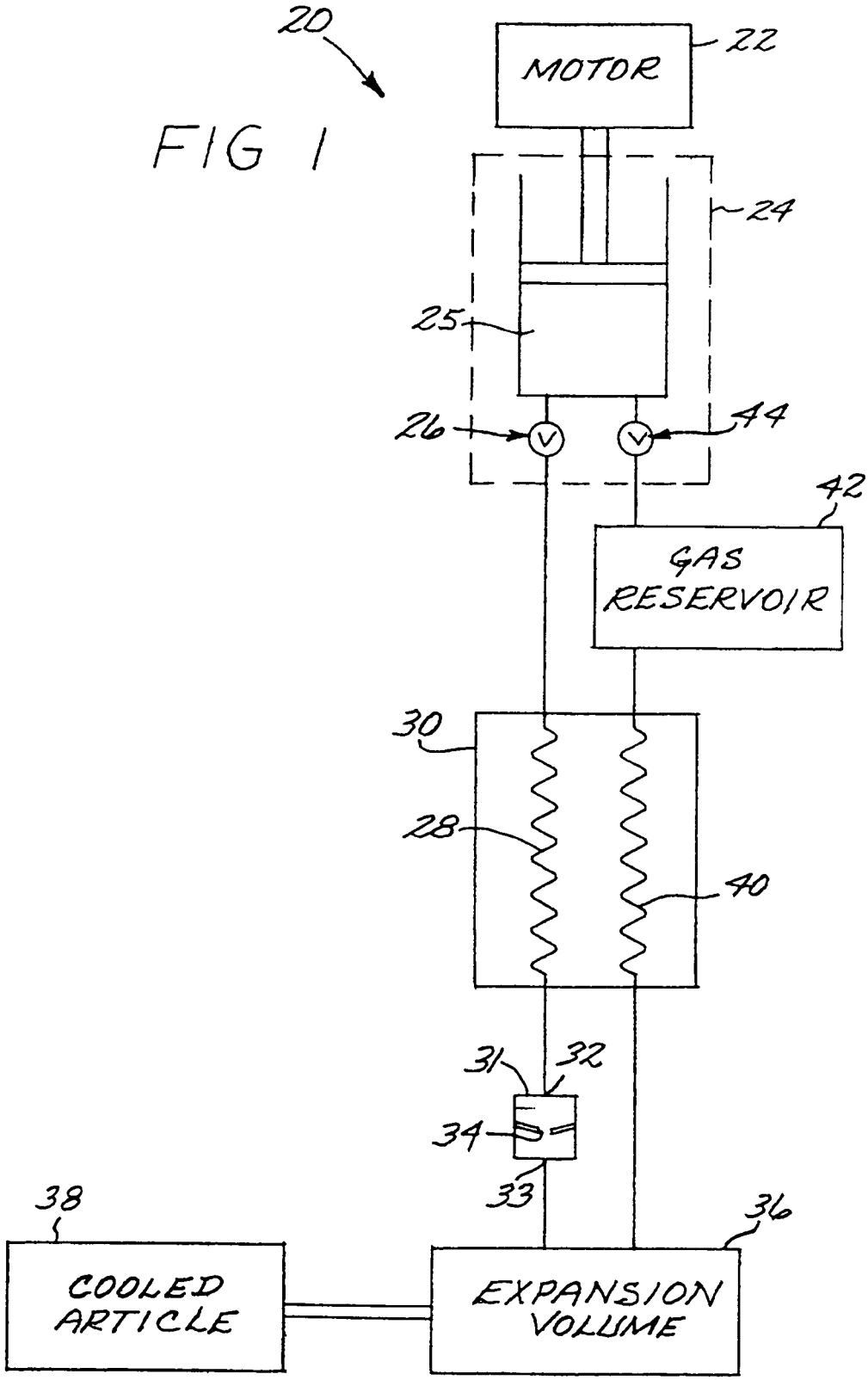
FIG. 1 is a schematic depiction of a cryogenic refrigeration system.

FIG. 1 depicts a cryogenic refrigeration system 20 based on the Joule-Thomson cycle. A drive motor 22 drives a compressor 24 to compress a working gas. The compressed working gas flows from a compression space 25 of the compressor 24, through an outlet valve 26, through a first channel 28 of a heat exchanger 30, and thence to an expansion nozzle 31 having a high-pressure nozzle inlet 32 and a low-pressure nozzle outlet 33. The compressed working gas expands through an orifice 34 in the expansion nozzle 31, and then into an expansion volume 36 that is in gaseous communication with the nozzle outlet 33. During the expansion through the orifice 34 and into the expansion volume 36, the working gas cools and in fact may partially liquefy. The expansion volume 36 is in thermal communication with a cooled article 38. In a case of most interest, the cooled article 38 is an infrared sensor or an electronic component that must be cooled to a temperature of less than about 15 K to be properly operable.

Heat flows from the cooled article 38 into the cooled working gas and/or liquefied working gas in the expansion volume 36, extracting heat from the cooled article 38. The now-warmed working gas flows through a second channel 40 of the heat exchanger 30 (which is preferably a countercurrent heat exchanger) to cool the incoming compressed working gas. The working gas is retained in a gas reservoir 42, until an intake movement of the compressor 24 draws the working gas through an inlet valve 44 and into the compression volume 25 of the compressor 24 to repeat the cooling cycle.

The working gas, preferably helium in the illustrated Joule-Thomson cryogenic refrigeration system 20 for achieving temperatures of less than about 15 K, must be compressed to the required pressure and also must be substantially free of condensable contaminants such as other gases with higher boiling points than the working gas. Such contaminants, if present, may condense in the orifice 34 and partially or completely plug it. For an otherwise leak-tight system, the main sources of contaminants are the drive motor 22 and the compressor 24. The present approach provides the drive motor 22 and compressor 24 that introduce substantially no contaminants into the working gas.

Figure 2:
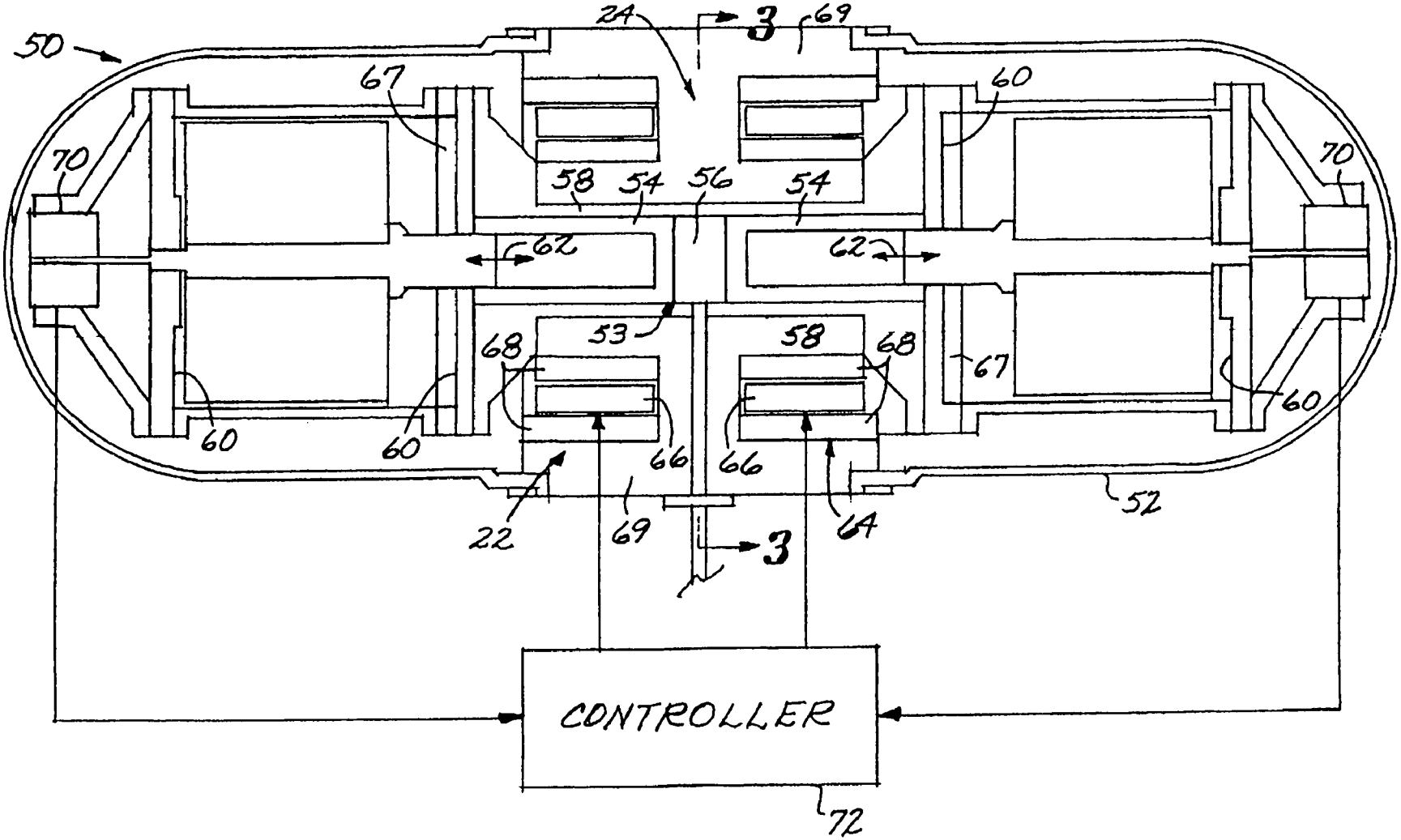
FIG. 2 is a schematic side sectional view of a compressor and drive motor according to the present approach.
Figure 3:
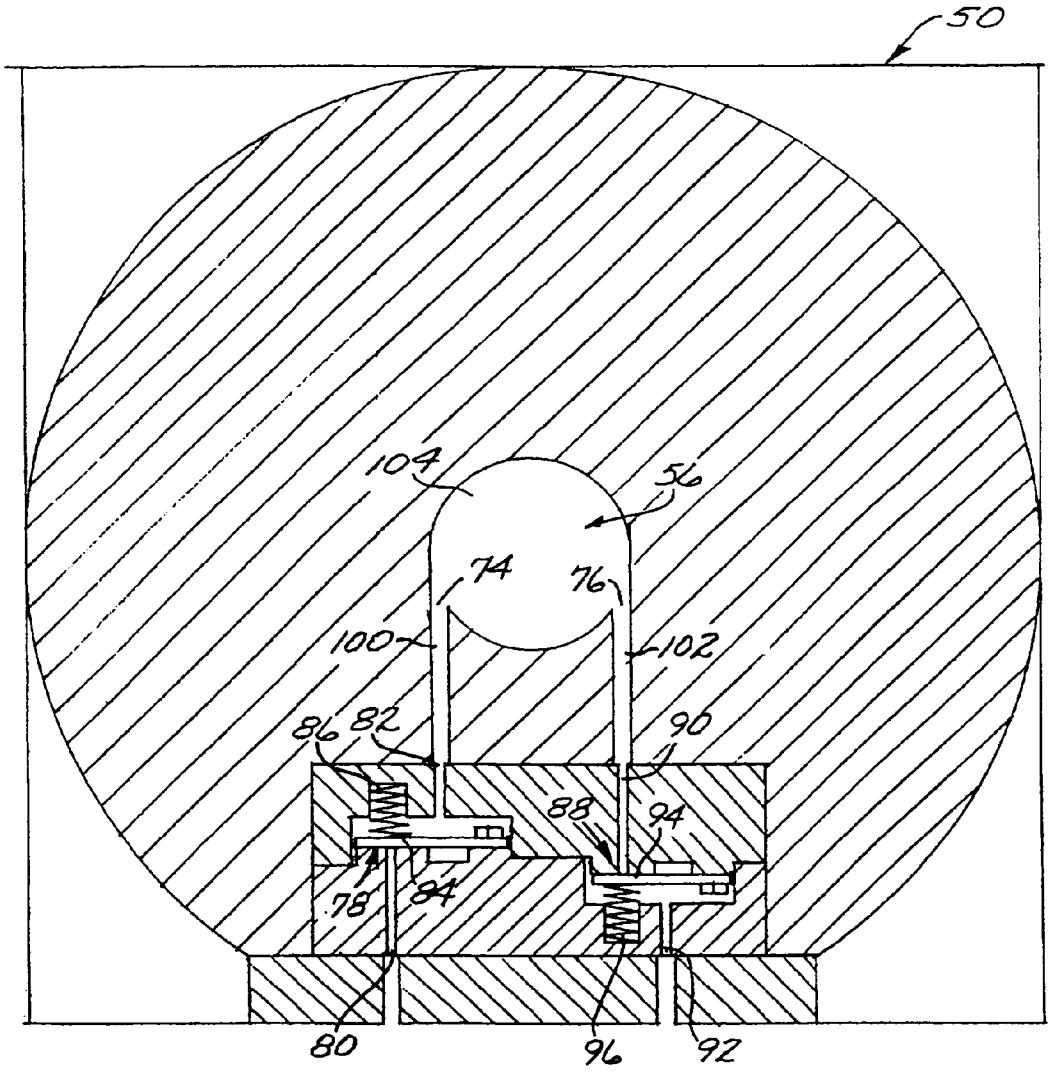
FIG. 3 is a sectional view of the compressor of FIG. 2, taken on line 3—3.

FIGS. 2 and 3 depict a motor/compressor module 50 that combines the drive motor 22, in the form of a linear drive motor 64, and the compressor 24 into a single assembly contained within a hermetically sealed housing 52 formed as a cylindrical side wall with domed ends. The housing 52 is preferably made of aluminum alloy pieces welded together to form the side wall and the domed ends. All electrical feedthroughs (not shown) for the motor coil and the positioning measuring instrumentation) are hermetic. The compressor 24 includes a reciprocating compression device 53, in this case having a pair of reciprocating opposing compression pistons 54 operable to compress gas within a compression volume 56 in a dynamically balanced manner. (Equivalently for the present purposes, the compressor 24 may include only a single reciprocating piston and a dynamic balancing mass that moves in opposition to the reciprocating piston.) The reciprocating compression pistons 54 are each contained within a metallic cylinder wall 58 which defines the reciprocating travel path for the compression pistons 54 and also the compression volume 56. In the illustrated design, the compression pistons 54 are each suspended by a set of metal flexures 60, typically made of steel. The metal flexures 60 are compliant in an axial direction 62 of reciprocating motion of the compression pistons 54 but rigid against transverse and torsional movements. The metal flexures 60 are preferably constructed of a stack of flat, spirally wound springs that are compliant in the axial direction 62 and stiff in the radial direction (i.e., perpendicular to the axial direction 62). This structure of the metal flexures 60 allows the compression pistons 54 to be driven by the drive motor 22, 64 in the axial direction 62 while remaining aligned within the cylinder wall 58. The inner diameter of each cylinder wall 58 is closely toleranced to the outer diameter of the moving piston 54 so as to provide a dynamic clearance seal, resulting in compression of the working gas within the compression volume 56 when the compression pistons 54 move toward each other and expansion within the compression volume 56 when the compression pistons 54 move apart. This flexure-mounting of the compression pistons 54 in combination with this dynamic sealing allows the use of a non-contacting, non-wearing, non-lubricated compressor structure.

The preferred drive motor 22 has an electromagnetic circuit including fixed, radially oriented permanent magnet assemblies 68, mounted into a permeable back iron structure 69, and circumferentially wound linear motor coils 66, which are located within the magnetic gap between the inner and outer permanent magnet assemblies 68. The linear motor coils 66 are affixed directly to a movable piston support structure 67 that is coupled to the compression pistons 54. Electrical current flowing through the linear motor coils 66 results in an axial force and a corresponding axial motion of the flexure 60, supported coil 66, and compression piston 54 assembly. Alternative approaches that are equivalent to the preferred approach for the present purposes, wherein the motor coil is fixed and the magnet structure is movable, or wherein the motor coil and the magnet structure are fixed and the back iron structure is movable, may be used. The linear motor coils 66 and permanent magnet assemblies 68 are hermetically sealed, thereby preventing potential volatile contamination by contaminants in the linear motor coils 66 and the permanent magnet assemblies 68 that would otherwise communicate with the working gas of the compressor 24 that is in the compression volume 56.

The position of each of the compression pistons 54 is measured by a linear variable differential transformer (LVDT) 70. The measured position is used by a feedback controller 72 to generate a control signal to each of the motor coils 66 and to ensure that the movements of the two individually driven compression pistons 54 are synchronized to each other. The LVDT assemblies 70 are hermetically sealed to prevent potential volatile contamination from communicating with the working gas of the compressor 24.

The structure of the motor/compressor module 50 as described to this point is known in the art for other applications.

As best seen in FIG. 3, the compression volume 56 has an inlet port 74 and an outlet port 76. A flapper inlet valve 78 has an inlet valve inlet 80 in gaseous communication (through the expansion volume 36, the second channel 40 of the heat exchanger 30, and the gas reservoir 42) with the nozzle outlet 33 in the closed-cycle cryogenic refrigeration system of FIG. 1, and an inlet valve outlet 82 in gaseous communication with the inlet port 74 of the compression volume 56. The flapper inlet valve 78 includes a flexible metallic flapper inlet seal 84 that opens when a gaseous pressure at the inlet valve inlet 80 is sufficiently greater than a gaseous pressure in the compression volume 56 to overcome the spring force of the metallic flapper inlet seal 84, and is otherwise closed. The flapper inlet seal 84 may be preloaded by a compression inlet-bias spring 86, or there may be no such inlet-bias spring. If such a compression inlet-bias spring 86 is present, the flapper inlet seal 84 opens when the gaseous pressure at the inlet valve inlet 80 is sufficiently greater than the gaseous pressure in the compression volume 56 to overcome the spring force of the metallic flapper inlet seal 84 and the spring force of the inlet-bias spring 86.

A flapper outlet valve 88 has an outlet valve inlet 90 in gaseous communication with the outlet port 76 of the compression volume 56, and an outlet valve outlet 92 in gaseous communication with the nozzle inlet 32 through the first channel 28 of the heat exchanger 30. The flapper outlet valve 88 includes a flexible metallic flapper outlet seal 94 that opens when a gaseous pressure at the outlet valve inlet 90 (i.e., the pressure in the compression volume 56) is sufficiently greater than a gaseous pressure in the outlet valve outlet 92 to overcome the spring force of the metallic flapper outlet seal 94, and is otherwise closed. The flapper outlet seal 94 may be preloaded by a compression outlet-bias spring 96, or there may be no such outlet-bias spring. If such a compression outlet-bias spring 96 is present, the flapper outlet seal 94 opens when the gaseous pressure at the outlet valve inlet 90 is sufficiently greater than the gaseous pressure in the outlet valve outlet 92 to overcome the spring force of the metallic flapper outlet seal 94 and the spring force of the outlet-bias spring 96.

Desirably, a total of an unswept void volume 100 of the inlet valve 78 and an unswept void volume 102 of the outlet valve 88 is sufficiently small, in relation to a swept volume 104 (that is, the volume traversed by the compression pistons 54 as they reciprocate) of the compression volume 56, that the compressor achieves a compression ratio of at least 15:1 in a single-stage of compression. If the compression ratio is less than 15:1, operational efficiency of the Joule-Thomson cryogenic refrigeration system 20 is reduced so that it is necessary to utilize a two-stage compressor (with its greater mechanical complexity, size, and weight) rather than the one-stage compressor illustrated here.

In the operation of the cryogenic refrigeration system 20, the working gas is drawn into the compression volume 56 through the flapper inlet valve 78 as the compression pistons 54 are drawn back from each other and the pressure within the compression volume 56 is reduced. The working gas is compressed within the compression volume 56 is compressed as the compression pistons 54 move toward each other. The flapper outlet valve 88 opens at a pressure determined by the effective stiffness of the flapper outlet seal 94, which in turn is determined by the material stiffness of the flapper outlet seal 94 and the spring constant of the outlet-bias spring 96, if any. The compressed working gas flows through the first channel 28 of the heat exchanger 30 and to the nozzle inlet 32. The compressed working gas expands through the orifice 34, loses pressure, and then flows back to the flapper inlet valve 78 through the expansion volume 36, the second channel 40 of the heat exchanger 30, and the gas reservoir 42.

The present approach has been reduced to practice in a prototype cryogenic refrigeration system, and been found to work as described.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A cryogenic refrigeration system comprising:

an expansion nozzle having a high-pressure nozzle inlet and a low-pressure nozzle outlet;

an expansion volume in gaseous communication with the nozzle outlet; and a compressor comprising a reciprocating compression device operable to compress gas within a compression volume, wherein the compression volume has an inlet port and an outlet port, a flapper inlet valve having an inlet valve inlet, and an inlet valve outlet in gaseous communication with the inlet port of the compression volume, wherein the inlet valve opens when a gaseous pressure at the inlet valve inlet is sufficiently greater than a gaseous pressure in the compression volume to overcome a spring force of the flapper inlet valve, and a flapper outlet valve having an outlet valve inlet in gaseous communication with the outlet port of the compression volume, and an outlet valve outlet in gaseous communication with the nozzle inlet, wherein the outlet valve opens when a gaseous pressure in the compression volume is greater than a gaseous pressure at the outlet valve outlet to overcome a spring force of the flapper outlet valve; and a drive motor system in driving mechanical communication with the compression device, wherein the compression volume is hermetically isolated from the drive motor system.

2. The cryogenic refrigeration system of claim 1, wherein a void volume of the flapper inlet valve and a void volume of the flapper outlet valve are sufficiently small, in combination with a swept volume of the compression volume, that the compressor achieves a compression ratio of at least 15:1 in a single-stage of compression.

3. The cryogenic refrigeration system of claim 1, wherein the inlet valve inlet is in gaseous communication with the nozzle outlet.

4. The cryogenic refrigeration system of claim 1, further including a heat exchanger, wherein the outlet valve outlet is in gaseous communication with the nozzle inlet through a first channel of the heat exchanger, and the nozzle outlet is in gaseous communication with the inlet valve inlet through a second channel of the heat exchanger.

5. The cryogenic refrigeration system of claim 1, wherein the compression device comprises a piston suspended by a flexure.

6. The cryogenic refrigeration system of claim 1, wherein the compressor and the drive motor system are contained within a single hermetically sealed compressor housing.

7. The cryogenic refrigerator of claim 1, wherein the compression device comprises a pair of opposing compression pistons.

8. The cryogenic refrigeration system of claim 7, wherein the drive motor system comprises a linear drive motor having a respective motor coil affixed to each one of the compression pistons, and a respective magnet structure that is static.

9. The cryogenic refrigeration system of claim 7, wherein the drive motor system comprises a linear variable differential transformer providing a measurement of a position of each of the compression pistons.

10. The cryogenic refrigeration system of claim 1, wherein neither the inlet valve nor the outlet valve includes a compression spring that preloads a flapper seal.

11. The cryogenic refrigeration system of claim 1, wherein at least one of the inlet valve and the outlet valve includes a compression spring that preloads a flapper seal.

12. The cryogenic refrigeration system of claim 1, further including a cooled article in thermal communication with the expansion volume.

13. A cryogenic refrigeration system comprising:

a Joule-Thomson expansion nozzle having a high-pressure nozzle inlet and a low-pressure nozzle outlet;

an expansion volume in gaseous communication with the nozzle outlet; and a compressor comprising a pair of opposing flexure-suspended compression pistons operable to compress gas within a compression volume, wherein the compression volume has an inlet port and an outlet port, a flapper inlet valve having an inlet valve inlet, and an inlet valve outlet in gaseous communication with the inlet port of the compression volume, wherein the inlet valve opens when a gaseous pressure at the inlet valve inlet is sufficiently greater than a gaseous pressure in the compression volume to overcome a spring force of the flapper inlet valve, and a flapper outlet valve having an outlet valve inlet in gaseous communication with the outlet port of the compression volume, and an outlet valve outlet in gaseous communication with the nozzle inlet, wherein the outlet valve opens when a gaseous pressure in the compression volume is greater than a gaseous pressure at the outlet valve outlet to overcome a spring force of the flapper outlet valve; and a drive motor system in driving mechanical communication with the compression pistons, wherein the compression volume is hermetically isolated from the drive motor system, and wherein the compressor and the drive motor system are contained within a single hermetically sealed compressor housing; and a heat exchanger, wherein the outlet valve outlet is in gaseous communication with the nozzle inlet through a first channel of the heat exchanger, and the nozzle outlet is in gaseous communication with the inlet valve inlet through a second channel of the heat exchanger.

14. The cryogenic refrigeration system of claim 13, wherein a void volume of the inlet valve and a void volume of the outlet valve are sufficiently small, in combination with a volume of the compression volume, that the compressor achieves a compression ratio of at least 15:1 in a single-stage of compression.

15. The cryogenic refrigeration system of claim 13, wherein the drive motor system comprises a linear drive motor having a respective motor coil affixed to each one of the compression pistons, and a respective magnet structure that is static.

16. The cryogenic refrigeration system of claim 13, wherein the drive motor system comprises a hermetically isolated linear variable differential transformer providing a measurement of a position of one of the compression pistons.

17. The cryogenic refrigeration system of claim 13, wherein each of the inlet valve and the outlet valve includes a compression spring that preloads a flapper seal.

18. The cryogenic refrigeration system of claim 13, further including a cooled article in thermal communication with the expansion volume.

* * * * *